US007044193B2

(12) United States Patent
Etzelsdorfer et al.

(10) Patent No.: US 7,044,193 B2
(45) Date of Patent: May 16, 2006

(54) METHOD OF CONTINUOUS CASTING

(75) Inventors: Kurt Etzelsdorfer, Leonding (AT); Gerald Hohenbichler, Kronstorf (AT); Christian Chimani, Pfarrkirchen (AT); Gerhard F Hubmer, Marchtrenk (AT); Dietmar Auzinger, Altenberg (AT)

(73) Assignee: Voest-Alpine Industrieanlagenbau GmbH & Co., (AT)

( * ) Notice: Subject to any disclaimer, the term of this patent is extended or adjusted under 35 U.S.C. 154(b) by 0 days.

(21) Appl. No.: 10/857,999

(22) Filed: Jun. 1, 2004

(65) Prior Publication Data

US 2004/0216861 A1 Nov. 4, 2004

Related U.S. Application Data

(63) Continuation of application No. PCT/AT02/00333, filed on Nov. 28, 2002.

(30) Foreign Application Priority Data

Nov. 30, 2001 (AT) ..... A 1877/2001

(51) Int. Cl.
*B22D 11/16* (2006.01)

(52) U.S. Cl. ..... 164/452; 164/453; 164/454; 164/480; 164/4.1

(58) Field of Classification Search ..... 164/452, 164/453, 454, 455, 154.5, 155.6, 155.4, 413, 164/414, 428, 154.6, 154.4, 4.1, 480; 700/148
See application file for complete search history.

(56) References Cited

U.S. PATENT DOCUMENTS

| | | | | |
|---|---|---|---|---|
| 5,031,688 | A | 7/1991 | Burgo et al. | |
| 5,052,467 | A | 10/1991 | Tanaka et al. | |
| 6,044,895 | A * | 4/2000 | Kuttner et al. | 164/155.4 |
| 6,085,183 | A | 7/2000 | Horn et al. | |
| 6,314,776 | B1 * | 11/2001 | Puda | 72/10.1 |
| 6,430,461 | B1 * | 8/2002 | Andorfer et al. | 700/148 |
| 6,526,328 | B1 * | 2/2003 | Maguin et al. | 700/148 |
| 6,575,225 | B1 * | 6/2003 | Hohenbichler et al. | 164/480 |

FOREIGN PATENT DOCUMENTS

| | | |
|---|---|---|
| CA | 2177831 | 8/1995 |
| JP | 60027458 | 2/1985 |

* cited by examiner

*Primary Examiner*—Kevin Kerns
*Assistant Examiner*—I.-H. Lin
(74) *Attorney, Agent, or Firm*—Ostrolenk, Faber, Gerb & Soffen, LLP

(57) ABSTRACT

In a method for the continuous casting of a thin metal strip according to the two-roll method, metal melt is cast into a casting gap formed by two casting rolls of the thickness of the metal strip to be cast, under formation of a melting bath.

In order to form a particular texture within the cast metal strip and/or to influence the geometry of the metal strip, continuous casting is carried out by an on-line calculation based upon an arithmetic model describing the formation of the particular texture of the metal and/or the formation of the geometry of the metal strip, wherein variables of the continuous casting method affecting the formation of the texture and/or the geometry are adjusted in an on-line dynamic fashion, i.e. while casting takes place.

25 Claims, 1 Drawing Sheet

METHOD OF CONTINUOUS CASTING

CROSS REFERENCE TO RELATED APPLICATION

This is a continuation of International Application No. PCT/AT02/00333, filed Nov. 28, 2002, published in the German language at WO 03/045607, which claims priority from Austrian application No. A 1877/2001 filed 30 Nov. 2001.

BACKGROUND OF THE INVENTION

The invention relates to a method for the continuous casting of a thin metal strip according to the two-roll method, in particular of a steel strip, preferably of a thickness which is less than 10 mm, wherein, under formation of a melting bath, metal melt is cast into a casting gap formed by two casting rolls of the thickness of the metal strip to be cast.

Methods of this kind are described in WO 95/15233 and EP-B1 0 813 700 as well as in AT-B 408.198. The first two documents relate to control procedures for the two-roll casting method, which are based upon process models but still exhibit the disadvantage that corrections can only be made once the controlled variables have deviated from the required actual values so that initially deviations to a more or less large extent from the required condition of the metal strip, for instance with regard to thickness, texture etc., have to be put up with, even if subsequently the process model is corrected such as described in EP-B 1 0 813 700.

SUMMARY OF THE INVENTION

The invention aims at avoiding those disadvantages and difficulties and has as its object to provide a continuous casting method of the initially described kind, which casting method makes it possible to comply with given quality features such as, in particular, the formation of a desired texture of the metal or the guarantee of a particular geometry, respectively, for the metal strip, namely for metals of various chemical compositions, i.e. for a variety of steel grades and steel qualities to be cast.

In particular, the invention has as its object to avoid from the beginning any deviations in quality of the metal strip by providing the possibility of interfering in manufacturing stages in which an actual value of the metal strip to be achieved and determining the quality is not yet easily recognizable or cannot be determined directly, respectively.

According to the invention, that object is achieved in that, to form a particular texture within the cast metal strip and/or to influence the geometry of the metal strip, continuous casting is carried out by an on-line calculation based upon an arithmetic model describing the formation of the particular texture of the metal and/or the formation of the geometry of the metal strip, wherein variables of the continuous casting method affecting the formation of the texture and/or the geometry are adjusted in an on-line dynamic fashion, i.e. while casting takes place.

In the strip casting process, the structure of the surfaces of the casting rolls forms an important factor of solidification or of the formation of the texture, respectively. That structure is reproduced by the liquid metal only to a certain degree, i.e., in correspondence with the surface structure of the casting rolls, increased solidification occurs in certain surface areas and delayed solidification occurs in other surface areas. According to the invention, preferably the structuring of the surface of the casting rolls is recorded, preferably is recorded on-line, and is integrated in the arithmetic model, under consideration of the conditions of solidification and segregation resulting therefrom, in particular during primary solidification.

For the solidification of the metal at the surfaces of the casting rolls, it is essential that those surfaces are conditioned, f.i. by purification, spraying, coating, in particular by flushing with gas or with gas mixtures, respectively. This gas or these gas mixtures, respectively, determine the heat transmission from the melt or the already solidified metal, respectively, to the casting rolls, and therefore, according to a preferred embodiment, the chemical composition of the gas or the gas mixture, respectively, as well as its amount and optionally its distribution throughout the length of the casting rolls are recorded, preferably are recorded on-line, and are integrated in the arithmetic model, under consideration of the conditions of solidification and segregation resulting therefrom, in particular during primary solidification.

In doing so, according to a preferred embodiment, thermodynamic changes of state of the entire metal strip such as changes in temperature are permanently joined in the calculation of the arithmetic model by solving a heat conduction equation and solving an equation or equation systems, respectively, describing the phase transition kinetics, and the temperature adjustment of the metal strip as well as optionally of the casting rolls is adjusted in dependence of the calculated value of at least one of the thermodynamic state quantities, wherein, for simulation, the thickness of the metal strip, the chemical analysis of the metal as well as the casting rate are taken into account, the values thereof being measured repeatedly, preferably during casting, and constantly, in particular with regard to the thickness.

By coupling according to the invention the temperature calculation of the billet with the arithmetic model including the formation of a particular time and temperature dependent metal texture, it is feasible to adjust the variables of the continuous casting method affecting continuous casting to the chemical analysis of the metal as well as to the billet's local thermal history. In this manner, a desired textural structure in the broadest sense (grain size, phase formation, precipitations) may selectively be ensured in the metal strip.

It has been shown that, according to the invention, a heat conduction equation in strongly simplified form may be employed, with a sufficiently high accuracy still being ensured when achieving the object of the invention. As the simplified heat conduction equation, the first fundamental theorem of thermodynamics suffices. The determination of ancillary conditions is of great importance.

Preferably, a continuous phase transition model of the metal is integrated in the arithmetic model, in particular in accordance with Avrami.

In its general form, the Avrami equation describes all diffusion-controlled transformation processes for the respective temperature, under isothermal conditions. By taking into account this equation in the arithmetic model, it is feasible to selectively adjust ferrite, perlite and bainite portions during the continuous casting of steel, while also taking into account a holding time at a particular temperature.

Preferably, the method is characterized in that thermodynamic changes of state of the entire metal strip such as changes in temperature are permanently joined in the calculation of the arithmetic model by solving a heat conduction equation and solving an equation or equation systems, respectively, describing the precipitation kinetics during and/or after solidification, in particular, of nonmetallic and intermetallic precipitations and in that the temperature adjustment of the metal strip as well as optionally of the casting rolls is adjusted in dependence of the calculated value of at least one of the thermodynamic state quantities, wherein, for simulation, the thickness of the metal strip, the chemical analysis of the metal as well as the casting rate are taken into account, the values thereof being measured repeatedly, preferably during casting, and constantly, in particular with regard to the thickness.

Thereby, the precipitation kinetics due to free phase energy and nucleus formation and the use of thermodynamic primary quantities, in particular Gibbs' energy, and the germ growth according to Zenor advantageously are integrated in the arithmetic model.

Suitably, quantitative relations of texture according to diagrams of multicomponent systems such as, for example, according to the Fe-C diagram, are integrated in the arithmetic model.

Advantageously, grain growth characteristics and/or grain formation characteristics are integrated in the arithmetic model, optionally under consideration of the recrystallization of the metal. Thereby, a dynamic and/or delayed recrystallization and/or a post recrystallization, i.e. a recrystallization later taking place in an oven, may be considered in the arithmetic model.

Preferably, single- or multiple-stage hot- and/or cold-rolling taking place during extraction of the metal strip is integrated in the arithmetic model as a variable of continuous casting also affecting an arrangement of texture, whereby thermomechanical rollings also taking place during continuous casting, for instance high-temperature thermomechanical rollings, may be considered at a billet temperature exceeding $A_{C3}$. According to the invention, reductions in thickness also occurring after the reeling of the strip as well as in low-temperature regions (f.i. at 200–300° C.), which may also be carried out on-line, i.e. without previous reeling, are regarded as rollings.

Furthermore, also the mechanical state such as the forming behaviour preferably is permanently joined in the calculation of the arithmetic model by solving further model equations, in particular by solving the continuum-mechanical fundamental equations for the visco-elastoplastic material behaviour.

A preferred embodiment is characterized in that a texture defined quantitatively is adjusted by imposing strand forming which has been computed on-line and leads to recrystallization of the texture.

Furthermore, a thermal influence on the metal melt and on the already solidified metal by the casting rolls suitably is integrated in the arithmetic model under on-line acquisition of the cooling of the casting rolls.

An additional advantage consists in that a thermal influence on the metal strip, such as cooling and/or heating, is integrated in the arithmetic model. In doing so, differences between the margin and the central region of the metal strip optionally must be considered.

An advantageous variant of the method according to the invention is characterized in that a rolling process model, preferably a hot-rolling process model, is integrated in the arithmetic model, whereby the rolling process model suitably comprises a calculation of rolling force and/or a calculation of lateral rolling power and/or a calculation of roll shifting for specially shaped rolls and/or a calculation of roll deformation and/or a forming calculation for thermally induced changes in rolling geometry.

According to the invention, mechanical characteristics of the metal strip such as apparent yielding point, resistance to extension, stretching etc. may be calculated in advance by means of the arithmetic model so that, in case a deviation of those precalculated values from predetermined targeting values is determined, it is feasible to make corrections in due course in those manufacturing stages which, in each case, are best suitable therefor, i.e. during solidification and the subsequent thermal influencing or during the subsequent rolling, recrystallization, respectively.

BRIEF DESCRIPTION OF THE DRAWING

In the following, the invention is explained in more detail by way of an exemplary embodiment shown in the drawing, with the FIGURE shown illustrating a continuous casting plant of the initially described kind in a schematic representation.

DESCRIPTION OF THE PREFERRED EMBODIMENT

Figure 1:
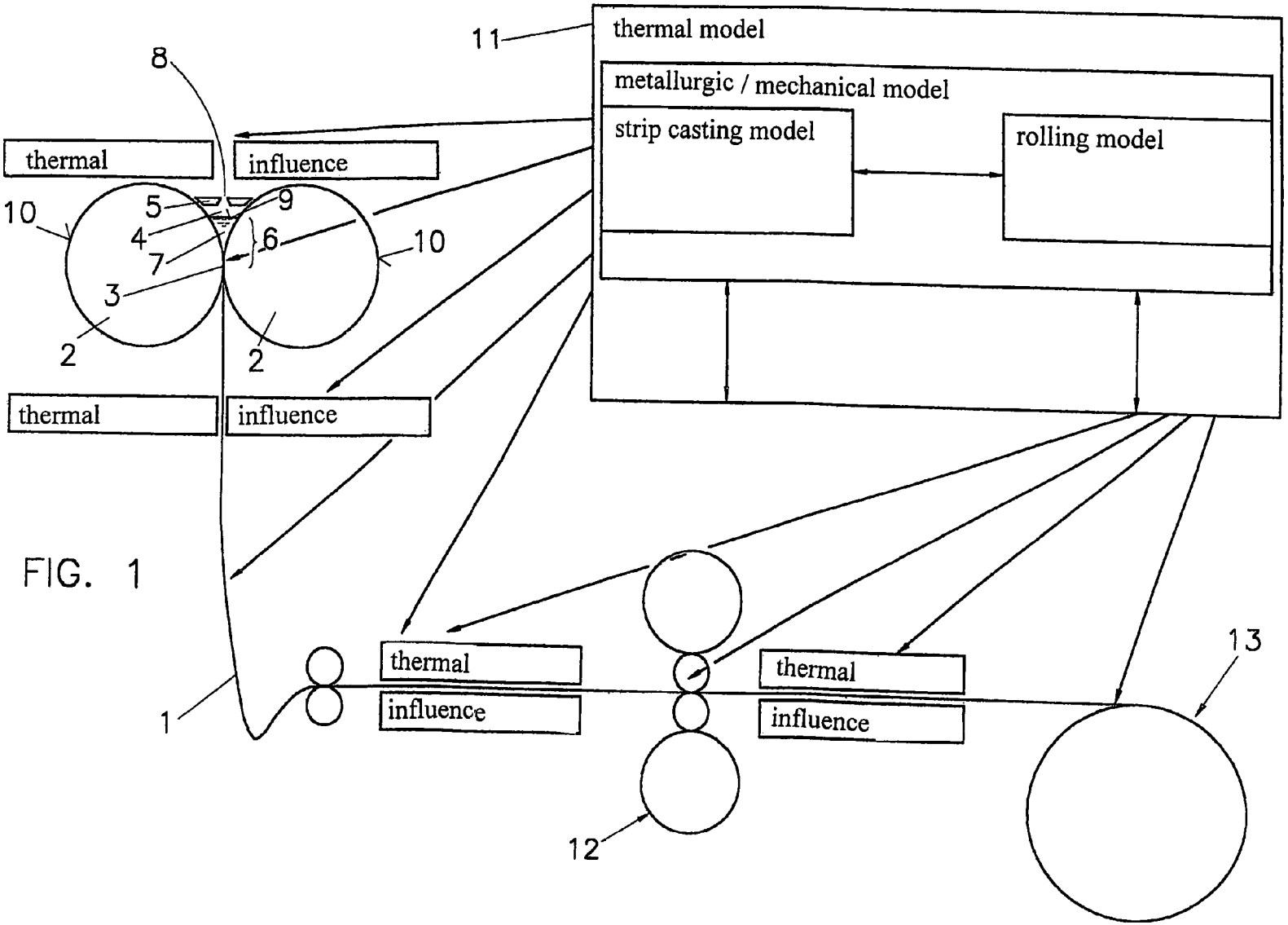

A continuous casting mould formed by two casting rolls 2 arranged in parallel to each other and side by side serves for casting a thin strip 1, in particular a steel strip having a thickness of between 1 and 10 mm. The casting rolls 2 form a casting gap 3, the so-called "kissing-point", at which the strip 1 emerges from the continuous casting mould. Above the casting gap 3, a space 4 is formed, which is shielded towards above by a covering plate 5 forming a cover and which serves for receiving a melting bath 6. Via an opening 8, the metal melt 7 is supplied to the cover, through which an immersion tube projects into the melting bath 6, to below the bath level 9. The casting rolls 2 are provided with an interior cooling not shown. Beside the casting rolls 2, lateral plates for sealing the space 4 receiving the melting bath 6 are provided.

At the surfaces 10 of the casting rolls 2, in each case a casting shell is formed, with those casting shells being united to a strip 1 in the casting gap 3, i.e. at the kissing point. In order to form in the best possible way a strip 1 having a roughly uniform thickness—preferably having a slight arch conforming to standards—it is essential that a specific distribution of rolling force, for instance in the form of a rectangle or a barrel, is provided in the casting gap 3.

In order to keep the structure of the surfaces of the casting rolls constant, brush systems may be provided, the brushes of which may be adjusted to the surfaces 10 of the casting rolls 2.

A computer 11 serves for ensuring the quality of the cast steel strip 1, into which computer machine data, the desired format of the metal strip, material data such as the chemical analysis of the steel melt, the casting state, the casting rate, the temperature of the liquid steel at which the steel melt enters between the casting rolls, as well as the desired texture and optionally a deformation of the steel strip, which may occur on-line or also outside the continuous casting plant, are entered. By means of a metallurgic arithmetic model comprising the phase transition kinetics and the kinetics of nucleus formation and by means of a thermal arithmetic model rendering possible the temperature analysis due to solving a heat conduction equation, the computer calculates various parameters affecting the quality of the hot strip such as a thermal influence on the steel melt and/or the steel strip as well as furthermore the interior cooling of the casting rolls, the gas admission to the casting rolls, the degree of deformation of the roll stand 12 arranged on-line in the example shown as well as optionally the reeling conditions for the reel 13 etc.

The arithmetic model used according to the invention essentially is based upon a strip casting model and a rolling model. The former comprises a casting roll, solidification, segregation, primary texture, phase transition and precipitation model. The rolling model comprises a thermophysical model, a phase transition, hot rolling, precipitation, recrystallization and grain size model as well as a model for predicting mechanical characteristic quantities.

The structuring of the surfaces 10 of the casting rolls is decisive for the initial solidification at the casting rolls 2. Thereby, the surface profile of the casting rolls 2 is reproduced by the steel 7, this, however, only to a certain extent. Due to the surface tension of the liquid steel 7 "valleys" are often bridged over, in which media (f.i. gases) are intercalated. Since the gases decrease the carrying-off of heat from the liquid steel 7 to the casting rolls 2, solidification is delayed.

The interplay between specially created casting roll surfaces 10 and various gas mixtures is used for adjusting a temperature suitable for the casting process. In doing so, it is necessary to exactly know and describe the nature of the surfaces 10 of the casting rolls. That is done by measuring the surface of the casting roll at several points (ideally for several times in axial direction, for instance with a highly sensitive measuring pin) after finishing surface working. The surface profiles obtained in this way are filtered and classified.

For each of those classes, heat transmissions are evaluated off-line by flow simulations and trials, and hence each surface class is assigned with a particular distribution of heat flows. Those heat flow/temperature distributions are delivered to the consecutively arranged program parts.

A preadjustment of the (integral) heat flows can be rendered possible by adjusting the temperature of the casting rolls. The latter, on the other hand, is determined by the casting roll materials, the cooling water temperature and the amount of cooling water.

Thus, the first step of this artithmetic model consists in describing the condition of the casting roll surface and in calculating the heat transmissions (surface "mountains", gas-filled "valleys", transitional areas) associated therewith and in classifying (fuzzyfying) them as well in conveying the respective temperatures.

In a second step, the primary solidification is worked out for the different classes. For this purpose, in trials the primary solidification (growth, orientation, lengths of dendrites, distances between dendrite arms) was predetermined by way of solidification trials and simultaneously was gone over by means of simulation calculations in combination with the temperature model (or by using a statistic model=cellular automaton). The object of this step consists in calculating the size distribution and growth direction of the dendrites.

In that step, dendrites growing (almost) in parallel are concentrated to grains. The result of that step is the assessment of the grain size distribution and possibly of a form factor (length/width).

A segregation model and a precipitation model serve for the determination of segregations and precipitations. In combination with the temperature model, the latter determines the degree of the precipitation processes being fuzzyfied, for the respective strip position.

By means of a mechanical model which evaluates and fuzzyfies the emerging textural tension together with the temperature model, it is feasible to predict cracking.

All parameters are delivered to a rolling model, the object of which consists in making predictions about the texture, mechanical parameters as well as cooling conditions in the discharge portion and geometrical parameters such as surface evenness.

All fuzzyfied parameters are delivered to an on-line calculation model, which evaluates the actual conditions for the steel strip 1 by means of the temperature model constantly running along and optionally exerts an influence on the control parameters by means of control circuits.

From already produced strips, quality characteristics are returned and are stored as well as correlated with the manufacturing parameters. In a self-learning loop, new process parameters are suggested.

Examples of arithmetic models such as they may be used for the invention can be found in the Austrian patent application A 972/2000.

What is claimed is:

1. A method for continuous casting of thin metal strip comprising from a melting bath of metal melt, moving metal melt into a casting gap formed between two opposing casting rolls, and setting the casting gap between the casting rolls at the thickness of the metal strip to be cast; and casting the metal strip to form a particular texture within the cast metal strip by performing an on-line calculation based upon an arithmetic model describing the forming of the particular texture and while casting occurs, adjusting variables of the continuous casting method that affect the formation of the texture within the cast metal strip in an on-line dynamic fashion.

2. The method of claim 1, further comprising influencing the geometry of the metal strip being continuously cast comprising performing an on-line calculation based upon an arithmetic model describing the formation of the geometry of the metal strip and adjusting during the casting second variables of the continuous casting method which affect geometry of the metal strip in an on-line dynamic fashion.

3. The method of claim 2, further comprising recording the structure of the surface of the casting rolls and integrating a recorded structure of the surface into the arithmetic models including considering the conditions of solidification of the metal strip and segregation resulting therefrom.

4. The method of claim 3, wherein the casting rolls have surfaces in the casting gap;

the method further comprising flushing the surfaces of the casting rolls above the melting bath with a gas; recording the chemical composition of the gas, the amount of the gas and optionally distribution of the gas along the length of the casting rolls and integrating the recorded information about the gas in the arithmetical models during consideration of conditions of solidification and segregation resulting therefrom.

5. The method of claim 2, further comprising integrating a mechanical state of the metal in the calculation of the arithmetic model by solving a further model equation including the continuum-mechanical fundamental equation for Visco-Elastoplastic material behavior.

6. The method of claim 2, further comprising determining thermodynamic changes of state of the metal strip and including the determined thermodynamic changes in the calculation of the arithmetic models, the determining comprising solving a heat conduction equation and solving an equation describing phase transition kinetics and adjusting the temperature of the metal strip and optionally the temperature of the casting rolls based upon the calculated value of at least one of thermodynamic state quantities, wherein for purpose of simulation values of the thickness of the metal strip, a chemical analysis of the metal and a casting rate are considered, and repeatedly measuring the values during casting.

7. The method of claim 6, further comprising integrating a continuous phase transition model of the metal into the arithmetic model.

8. The method of claim 7, wherein the arithmetic model is in accordance with Avrami.

9. The method of claim 1, further comprising determining thermodynamic changes of state of the metal strip and including that determined thermodynamic changes in the calculation of the arithmetic models, the determining comprising solving a heat conduction equation and solving an equation describing precipitation kinetics at least one of during and after solidification of the metal strip, of the non-metallic and inter-metallic precipitations and adjusting the temperature of the metal strip and optionally the temperature of the casting rolls dependent upon the calculated value of at least one of the thermodynamic state quantities, wherein for purpose of simulation values of the thickness of the metal strip, a chemical analysis of the metal and a casting rate are considered, and repeatedly measuring the values during casting.

10. The method of claim 9, further comprising integrating precipitation kinetics due to free phase energy and nucleus formation and the use of thermodynamic primary quantities and germ growth according to Zener in the arithmetic model.

11. The method of claim 1, further comprising integrating quantitative relations of texture according to diagrams of multicomponent systems of the metal strip are in the arithmetic model.

12. The method of claim 1, further comprising integrating at least one of grain growth characteristics and grain formation characteristics in the arithmetic model and optionally considering re-crystallization of the metal.

13. The method of claim 1, wherein the rolling of the metal strip is conducted in rolling stages each selectively one of hot or cold rolling and integrating the stages of the rolling during extraction of the metal strip into the arithmetic model as a variable of the continuous casting affecting formation of texture of the metal strip.

14. The method of claim 1, further comprising recording the structure of the surface of the casting rolls and integrating a recorded structure of the surface into the arithmetic models including considering the conditions of solidification of the metal strip and segregation resulting therefrom.

15. The method of claim 1, further comprising adjusting a texture defined quantitatively by imposing a strand forming which has been computed on-line so as to lead to re-crystallization of the texture of the metal strip.

16. The method of claim 1, further comprising integrating thermal influence on the metal melt and on the already solidified metal strip caused by the casting roll, the influence being integrated in the arithmetic model under an on-line acquisition of cooling of the casting rolls.

17. The method of claim 1, further comprising integrating into the arithmetic models a thermal influence on the metal strip of cooling or heating.

18. The method of claim 1, further comprising integrating a rolling process model into the arithmetic models.

19. The method of claim 18, wherein the rolling process model comprises calculating rolling force.

20. The method of claim 19, wherein the rolling process model further comprises a calculating lateral rolling power.

21. The method of claim 20, wherein the rolls are specially shaped and the rolling process model comprises a calculation of roll shifting for specially shaped rolls.

22. The method of claim 20, wherein the rolling process model comprises calculation of roll deformation.

23. The method of claim 18, wherein the rolling process model comprises calculating for a thermally induced change in rolling geometry.

24. The method of claim 1, further comprising integrating mechanical characteristics of the metal strip including apparent yielding point, resistance to extension and stretching into the arithmetical model or calculating the characteristics for the end of the strip casting process.

25. The method of claim 1, wherein the casting rolls are set with a casting gap so that the thin metal strip has a thickness less than 10 mm.

* * * * *